US005463955A

United States Patent [19]

Carriere

[11] Patent Number: 5,463,955

[45] Date of Patent: Nov. 7, 1995

[54] TRANSMISSION TUBE CONNECTOR

[75] Inventor: Raymond Carriere, Brownsburg, Canada

[73] Assignee: ICI Canada Inc., Ontario, Canada

[21] Appl. No.: 193,332

[22] Filed: Feb. 8, 1994

[51] Int. Cl.[6] ..... C06C 5/04

[52] U.S. Cl. ..... 102/275.2; 102/275.4; 102/317; 102/320

[58] Field of Search ..... 102/275.2, 275.7, 102/317, 320

[56] References Cited

U.S. PATENT DOCUMENTS

| | | | |
|---|---|---|---|
| 1,968,565 | 7/1934 | Mallet | 102/8 |
| 2,952,206 | 9/1960 | Becksted | 102/27 |
| 3,175,491 | 3/1965 | Robertson | 102/27 |
| 3,205,818 | 9/1965 | Coulson | 102/27 |
| 4,699,059 | 10/1987 | Kelly et al. | 102/275.7 |
| 4,714,018 | 12/1987 | Lofgren | 102/275.7 |
| 4,815,382 | 3/1989 | Yunan | 102/275.7 |
| 5,024,158 | 6/1991 | Kennedy et al. | 102/275.11 |
| 5,286,053 | 2/1994 | Lenzen et al. | 280/734 |

*Primary Examiner*—Peter A. Nelson
*Attorney, Agent, or Firm*—Charles Q. Buckwalter

[57] ABSTRACT

The present invention is directed to a connector for transmission tubes wherein a first initiated transmission tube transfers a signal to a second transmission tube within said connector.

9 Claims, 1 Drawing Sheet

TRANSMISSION TUBE CONNECTOR

The present invention is directed to a device for connecting transmission tubes for the initiation of the detonation of bulk explosives.

Usually, in the initiation of the detonation of bulk explosives, transmission tubes are used to connect one bore hole to another to form a series of connected bore holes. The transmission tubes for the nonelectric transmission of signals between two points are generally comprised of plastic tubes with an explosive mix adhered to the inside of the tube. Another form of transmission tube is a core of explosives surrounded by textiles, known to those skilled in this art as a detonating cord. A problem in this art is connecting tubes together. Tubes are manufactured in short lengths such as one meter up to reels of several hundred meters. Once manufactured, for a tube to be useful for explosive purposes it must be connected to something. To transmit a signal from a transmission tube to some other device or tube, a connection must be made that insures the continuity of the transmission tube signal. If there is no continuity in the transfer of the signal, there is no connected series and the planned explosive scheme will fail.

In the past this problem has been solved by simply knotting two tubes together. Knotting, however, is not always reliable since the tube must be contorted to form a knot which concentrates the energy source which may cause premature detonation and sometimes results in loss of the explosive powder, which is adhered to the inside of the tube wall. It is the explosive powder which is the agent of the signal transmission. Other kinds of connectors have been proposed which either attempt to connect the tubes as a single tube or form some kind of overlap.

The present invention is directed to a device which provides a simple connection of the tubes without forming a knot or making separate tubes into a single tube. The connector is easy to use and can connect a variety of transmission tubes, such as detonator cord and shock tube. This connector has been found to be particularly effective in its use in salt mines, since during the explosion the connector is believed to be vaporized and, therefore, consumed in use. Another advantage is the lessened dependence upon the use of detonator cord in the emulsion filled bore hole, since detonator cord desensitises the emulsion to detonation due to the transfer of energy through the cord. A shock tube does not produce the same effect as detonator cord in the emulsion filled bore hole. The connector provides a further advantage in that due to tensile resistance provided in the connection which resists being pulled apart once a connection has been made.

SUMMARY OF THE INVENTION

Figure 2:
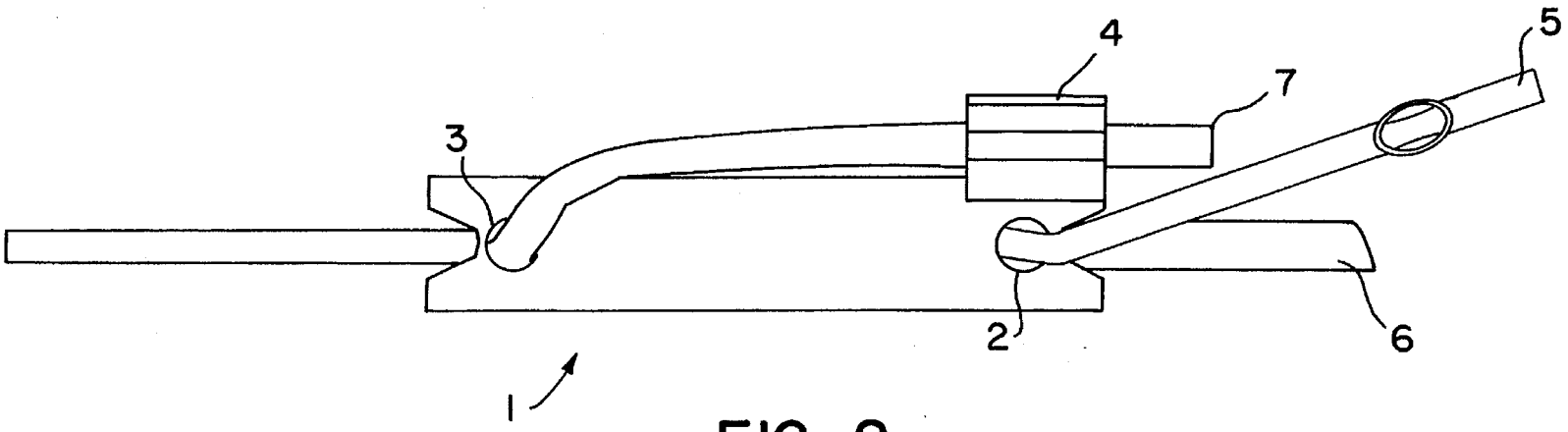
FIG. 2 shows the connector with detonating cord and shock tube.

A tubular connector with an inside portion and an outside portion for connecting at least two nonelectric transmission tubes wherein said tubes are secured by a tubing holding means at each end of said connector and a segment of each tube is substantially linearly juxtaposed one to the other within said inside portion which provides a means for the transfer of a signal from an initiated first transmission tube to a second transmission tube wherein said first tube signal terminates at said connector and said first tube is provided with a terminal end, said terminal end affixed to said outside portion of said connector to insure that said first tube terminal end does not transfer signal from said outside portion of said connector whereby said signal transfer occurs within said inside portion of said connector at the substantially linear juxtaposition. The tubular connector comprises any geometrical shape which can accommodate a substantially linear juxtaposition for transmission tubes. For example, the connector may be cylindrical or rectangular, since both geometries provide positional relationship and both provide an inside portion and an outside portion. The preferred tubular geometry is cylindrical, the cylinder approximating from about 5 to 10 centimeters in length and most preferably, 6 centimeters.

The connected transmission tubes may be any of the types of nonelectric tubes known to those skilled in this art. The connection may comprise detonator cords to detonator cords or detonator cords to shock tubes. The holding means in the connector comprises a pressure fitted orifice which approximates the size of a transmission tube. Preferably the orifice is slightly smaller than the transmission tube so that the transmission tube becomes slightly compressed upon insertion into the orifice. The pressure fit provides tensile resistance so that the tubes may be handled without being pulled out of or away from the connector.

The tubes must be placed within the connector so that ultimately a signal is communicated from the initiated tube to the uninitiated tube. This is accomplished in a tubular connector by the tubes being substantially linearly juxtaposed to one another. Simply, this means that the tubes are near enough to each other to enable signal transfer. The relative positions of the tubes is dictated by the geometry of the connector, the linear shape of the tubes themselves and the need to be close enough to transfer a signal from the ignited to the unignited tube. The outside diameter of the connector should be no greater than about 2 centimeters and the inside diameter may be small enough to accommodate the transmission tube diameters which may be in active communication.

The connector diameter should be no greater than about 4 centimeters. This dimension is determined by the size of the bore hole and by the requirement that the connected tubes must be close enough to transfer signal. Bore hole requirements dictate that the connector itself should not be of such size to obstruct the emulsion explosive loading means to the bore hole.

A selective and very advantageous purpose of the present invention is its use to connect detonating cord with a shock tube in the removal of salt from a salt mine. For the purpose of salt mining, a preferred connector for transmission tubes is one which after the explosion is not to be found. Therefore, in its most preferred embodiment, the present invention connects detonating cord and shock tube, with substantially all of the shock tube and connector in the bore hole and as little detonating cord in the bore hole as is practicable. The use of as little detonating cord as possible is advantageous as stated above, since initiation of the detonating cord will cause interaction with the emulsion thus decreasing the amount of energy available for bore hole explosion.

Color of the connector is generally not an issue. Usually brightly colored connectors are chosen for ease of sight in determining where a connection has been made. For the purpose of salt mine excavation, however, a natural or white color is preferred.

The connector may be made of any resilient type of plastic material. It is preferable that the plastic material be somewhat rigid since tensile resistance is important to the invention in its most favorable aspect. The most preferred material is high density polyethylene. Preferred materials are thermosets, epoxies, amides, polycarbonates, thermoplastics, low and medium density polyethylenes, nylons, such as nylon 66, blends of the above, and combinations thereof and therebetween.

The connector is manufactured by any of the common means known by those skilled in this art and the plastics art for forming shapes and forms from plastic and plastic-like materials. In this particular manufacture for the present invention, injection molding of the device is preferred. However, any molding means is capable of producing an operable device.

DETAILED DESCRIPTION

Figure 3:
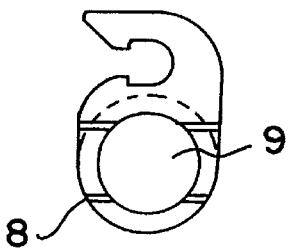
FIG. 3 shows a cross section of the connector showing the inside and outside portions and holding means.
Figure 1:
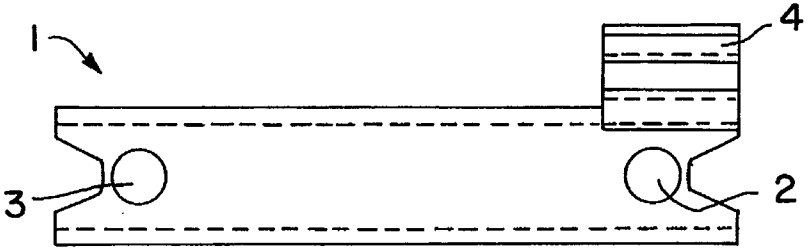
FIG. 1 is the connector showing the holding means and terminal end affixation means.

FIG. 1 shows connector, 1, orifices 2 and 3 for holding transmission tubes and holding means 4, for affixing the terminal end of the first transmission tube. FIG. 2 shows the connector, 1, combined with detonating cord, 6, and shock tube, 5. The terminal end, 7, is affixed in holding means 4. Shock tube, 5, is press fit into orifice, 2, whereas detonating cord, 6, is press fit into orifice, 3. FIG. 3 is a cross section of the connector which shows the outside portion, 8, and the inside portion, 9. The transmission tubes are substantially linearly juxtaposed within inside portion 9 and this is the portion of the connector wherein said signal transfer occurs. Holding means, 4, may be advantageously placed on any outside portion, 8, where such placement provides for the removal of the terminal end, 7, so that said terminal end does not transfer a signal to the shock tube, 5.

I claim:

1. A tubular connector with an inside portion and an outside portion for connecting at least two nonelectric transmission tubes wherein said tubes are secured by a tubing holding means at both ends of said connector and a segment of each tube is substantially linearly juxtaposed one to the other within said inside portion which provides a means for the transfer of a signal from an initiated first transmission tube to a second transmission tube wherein said first tube signal terminates at said connector and said first tube is provided with a terminal end, said terminal end affixed to said outside portion of said connector to insure that said first tube terminal end does not transfer signal from said outside portion of said connector whereby said signal transfer occurs within said inside portion of said connector at the substantially linear juxtaposition.

2. The connector of claim 1 wherein said connector is cylindrical.

3. The connector of claim 1 wherein said connector is 7 centimeters in length.

4. The connector of claim 1 wherein said connector has a diameter no greater than 2 centimeters.

5. The connector of claim 1 wherein said first tube is a detonating cord.

6. The connector of claim 1 wherein said second tube is a shock tube.

7. The connector of claim 1 wherein said connector is white or natural.

8. The connector of claim 1 wherein said connector is high density polyethylene.

9. The method of using the connector of claim 1 wherein said connector is used in salt mining operations.

* * * * *